US005080075A

United States Patent [19]

Miwa et al.

[11] Patent Number: 5,080,075

[45] Date of Patent: Jan. 14, 1992

[54] ACCELERATION ENRICHMENT RELATED CORRECTION FACTOR LEARNING APPARATUS FOR INTERNAL COMBUSTION ENGINE

[75] Inventors: Hiromichi Miwa, Yokohama; Yosihisa Sugimoto, Shizuoka, both of Japan

[73] Assignee: Nissan Motor Co., Ltd., Yokohama, Japan

[21] Appl. No.: 630,206

[22] Filed: Dec. 19, 1990

[30] Foreign Application Priority Data

Dec. 21, 1989 [JP] Japan ..... 1-329719

[51] Int. Cl.[5] ..... F02D 41/10

[52] U.S. Cl. ..... 123/492; 364/431.05

[58] Field of Search ..... 123/478, 480, 486, 488, 123/492; 364/431.04, 431.05, 431.07

[56] References Cited

U.S. PATENT DOCUMENTS

| | | | |
|---|---|---|---|
| 4,513,722 | 4/1985 | Hasegawa | 123/492 |
| 4,580,539 | 4/1986 | Kitahara | 123/440 |
| 4,592,325 | 6/1986 | Nakagawa | 123/489 |
| 4,658,790 | 4/1987 | Kitahara | 123/440 |
| 4,754,736 | 7/1988 | Yamato et al. | 123/492 |
| 4,776,943 | 10/1988 | Kitahara | 204/427 |
| 4,864,999 | 9/1989 | Fujisawa | 123/492 |
| 4,976,242 | 12/1990 | Sonoda et al. | 123/492 X |
| 5,003,950 | 4/1991 | Kato et al. | 123/492 X |

FOREIGN PATENT DOCUMENTS 63-41634 2/1988 Japan .

OTHER PUBLICATIONS

Service Periodical, Nissan Maxima, (F007611), published in 1-1988.

*Primary Examiner*—Willis R. Wolfe
*Attorney, Agent, or Firm*—Foley & Lardner

[57] ABSTRACT

A fuel delivery control apparatus for use with an internal combustion engine for controlling the amount of fuel metered to the engine based upon engine operating conditions. A control unit is provided for calculating an acceleration enrichment related correction factor from a relationship programmed into the control unit to correct the amount of fuel metered to the engine so as to provide acceleration enrichment for a predetermined period of time after the engine acceleration starts. This relationship defines the acceleration enrichment related correction factor as a function of selected engine operating conditions. The relationship is corrected based upon recent engine operating conditions.

7 Claims, 9 Drawing Sheets

ACCELERATION ENRICHMENT RELATED CORRECTION FACTOR LEARNING APPARATUS FOR INTERNAL COMBUSTION ENGINE

BACKGROUND OF THE INVENTION

This invention related to a fuel delivery control apparatus for controlling the amount of fuel metered to an internal combustion engine and, more particularly, to an apparatus for learning an acceleration enrichment related correction factor used in correcting the amount of fuel metered to the engine to provide acceleration enrichment in response to a demand for engine acceleration.

For example, Japanese Patent Kokai No. 63-41634 discloses a fuel delivery control apparatus for controlling the amount of fuel metered to an internal combustion engine. The fuel delivery control apparatus employs a digital computer for calculating a desired value for fuel delivery requirement in the form of fuel-injection pulse-width and timing. A basic fuel-injection pulse-width value Tp is calculated by the digital computer central processing unit as $Tp=K\times Q/N$ where K is a constant, Q is the intake air flow and N is the engine speed. The calculated basic value Tp is then corrected for various engine operating parameters. The corrected fuel-injection pulse-width value Ti is given as $$Ti=Tp\times \mathrm{COEF}\times \mathrm{ALPHA}+Ts$$

where ALPHA is a correction factor related to the oxygen content of the exhaust gases for providing a closed loop air/fuel ratio control, Ts is a correction factor related to the voltage of the car battery, and COEF is a correction factor given as $$\mathrm{COEF}=1+KTw+KMR+KAS+KAI+KFUEL+$$

where KTw is a correction factor decreasing as the engine coolant temperature increases, KMR is a correction factor related to a desired air/fuel ratio, KAS is a correction factor for providing fuel enrichment control when the engine is cranking, KAI is a correction factor for providing fuel enrichment control when the engine is idling, and KFUEL is a correction factor for providing fuel enrichment control when the engine is accelerating. The calculated values for fuel-injection pulse width and fuel-injection timing are transferred to a fuel-injection-control logic circuit. The fuel-injection-control logic circuit then sets the fuel-injection timing and fuel-injection pulse-width according to the calculated values for them.

The correction factor KFUEL is found from a predetermined relationship stored in the read only memory of the digital computer. The predetermined relationship defines correction factor KFUEL as a function of engine operating conditions. Since the relationship cannot be modified after it is stored in the read only memory, however, the correction factor KFUEL will deviate from an optimum value, causing degraded drivability and harmful emission increase due to engine and fuel delivery system changes with time.

SUMMARY OF THE INVENTION

Therefore, it is a main object of the invention to provide an improved fuel delivery control apparatus which has a learning control function of relating the correction factor KFUEL to recent engine operating conditions.

There is provided, in accordance with the invention, a fuel delivery control apparatus for use with an internal combustion engine. The control apparatus comprises sensors for deriving sensor signals indicative of existing values of engine operating conditions, and an air/fuel ratio sensor sensitive to exhaust gases discharged from the combustion chambers for producing a signal indicative of an air/fuel ratio at which the engine is operating. A control unit is coupled to the sensors for controlling the amount of fuel metered to the engine based upon the sensed engine operating conditions. The control unit includes means for calculating an acceleration enrichment related correction factor KFUEL from a relationship programmed into the control unit to correct the amount of fuel metered to the engine so as to provide acceleration enrichment for a predetermined period of time after the engine acceleration starts. The relationship defines the acceleration enrichment related correction factor as a function of selected engine operating conditions. The control unit also includes means for correcting the relationship based upon recent engine operating conditions.

BRIEF DESCRIPTION OF THE DRAWINGS

The invention will be described in greater detail by reference to the following description taken in connection with the accompanying drawings, in which.

DETAILED DESCRIPTION OF THE INVENTION

Figure 1:
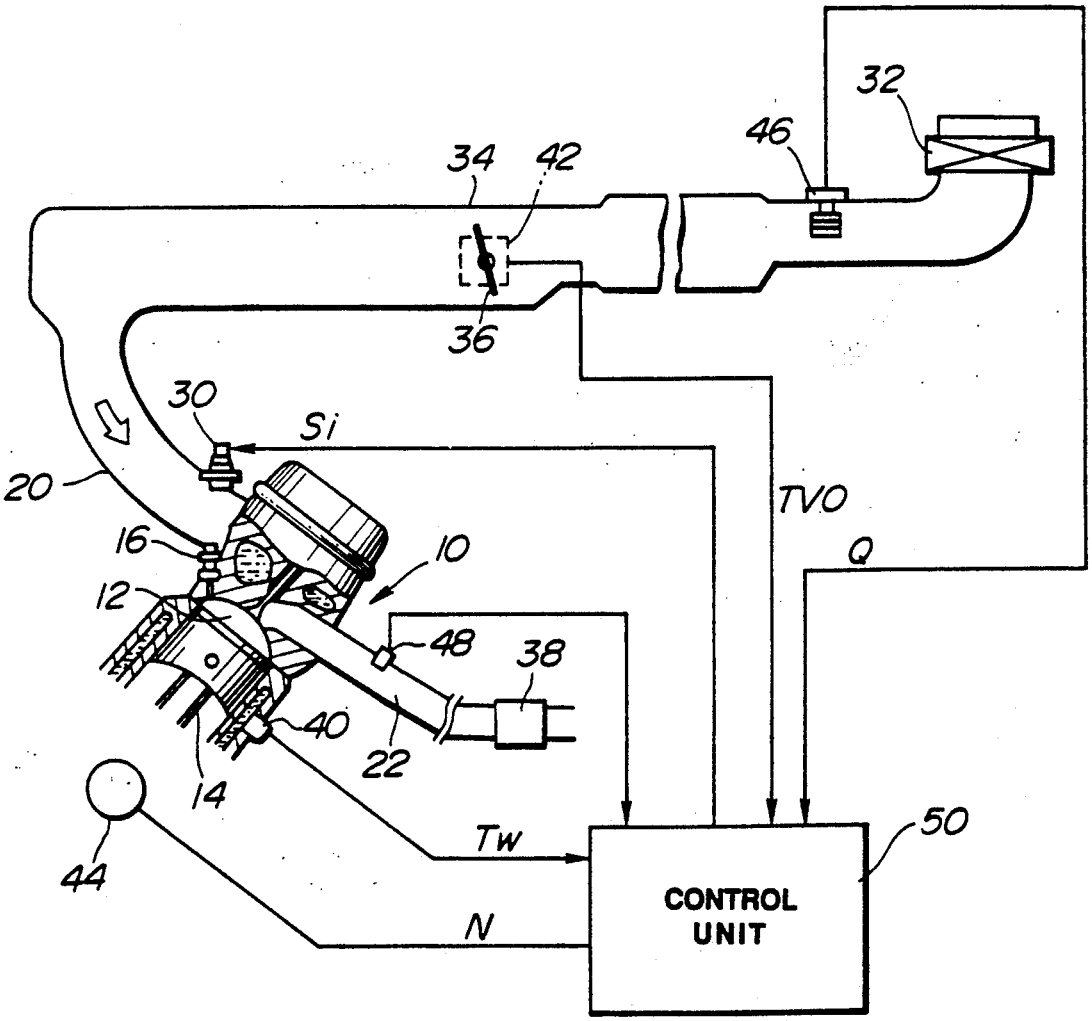
FIG. 1 is a schematic diagram of an internal combustion engine to which the invention is applicable.

With reference to the drawings, and in particular to FIG. 1, there is shown a schematic diagram of a fuel delivery control apparatus embodying the invention. An internal combustion engine, generally designated by the numeral 10, for an automotive vehicle includes combustion chambers or cylinders, one of which is shown at 12. A piston 14 is mounted for reciprocal motion within the cylinder 12. A crankshaft (not shown) is supported for rotation within the engine 10 in response to reciprocation of the piston 14 within the cylinder 12.

An intake manifold 20 is connected with the cylinder 12 through an intake port with which an intake valve (not shown) is in cooperation for regulating the entry of combustion ingredients into the cylinder 12 from the intake manifold 20. A spark plug 16 is mounted in the top of the cylinder 12 for igniting the combustion ingredients within the cylinder 12 when the spark plug 16 is energized by the presence of high voltage electrical energy. An exhaust manifold 22 is connected with the cylinder 12 through an exhaust port with which an exhaust valve 18 is in cooperation for regulating the exit of combustion products, exhaust gases, from the cylinder 12 into the exhaust manifold 22. The intake and exhaust valves are driven through a suitable linkage with the crankshaft.

A fuel injector 30 is mounted for injecting fuel into the intake manifold 20 toward the intake valve. The fuel injector 30 opens to inject fuel into the intake manifold 12 when it is energized by the presence of electrical signal Si. The length of the electrical pulse, that is, the pulse-width, applied to the fuel injector 30 determines the length of time the fuel injector 30 opens and, thus, determines the amount of fuel injected into the intake manifold 20.

Air to the engine 10 is supplied through an air cleaner 32 into an induction passage 34. The amount of air permitted to enter the combustion chamber 12 through the intake manifold 20 is controlled by a butterfly throttle valve 36 located within the induction passage 34. The throttle valve 36 is connected by a mechanical linkage to an accelerator pedal (not shown). The degree to which the accelerator pedal is depressed controls the degree of rotation of the throttle valve 36. The accelerator pedal is manually controlled by the operator of the engine control system. In the operation of the engine 10, the exhaust gases are discharged into the exhaust manifold 22 and hence to the atmosphere through a catalytic converter 38.

The amount of fuel metered to the engine, this being determined by the width of the electrical pulses Si applied to the fuel injector 30 is repetitively determined from calculations performed by a digital computer, these calculations being based upon various conditions of the engine that are sensed during its operation. These sensed conditions include engine coolant temperature $T_W$, exhaust oxygen content, throttle valve position TVO, engine speed N, and intake air flow Q. Thus, a engine coolant temperature sensor 40, a throttle position sensor 42, a crankshaft position sensor 44, a flow meter 46, and an air/fuel ratio sensor 48 are connected to a control unit 50.

The engine coolant temperature sensor 40 is mounted in the engine cooling system and comprises a thermistor connected to an electrical circuit capable of producing a coolant temperature signal in the form of a DC voltage having a variable level proportional to coolant temperature. The throttle position sensor 42 is a potentiometer electrically connected to a voltage divider circuit for producing a throttle position signal in the form of a DC voltage proportional to throttle valve position. The crankshaft position sensor 44 is provided for producing a series of crankshaft position electrical pulses, each corresponding to two degrees of rotation of the engine crankshaft, of a repetitive rate directly proportional to engine speed and a predetermined number of degrees before the top dead center position of each engine piston. The flow meter 46 is responsive to the air flow through the induction passage 34 and it produces an intake airflow signal proportional thereto.

The air/fuel ratio sensor 48 is provided to probe the exhaust gases discharged from the cylinders 12 and it is effective to produce a signal indicative of the air/fuel ratio at which the engine is operating. For example, the air/fuel ratio sensor 48 may be a device disclosed in greater detail in U.S. Pat. Nos. 4,776,943 and 4,658,790 assigned to the assignee of this invention and which are hereby incorporated by reference.

Figure 2:
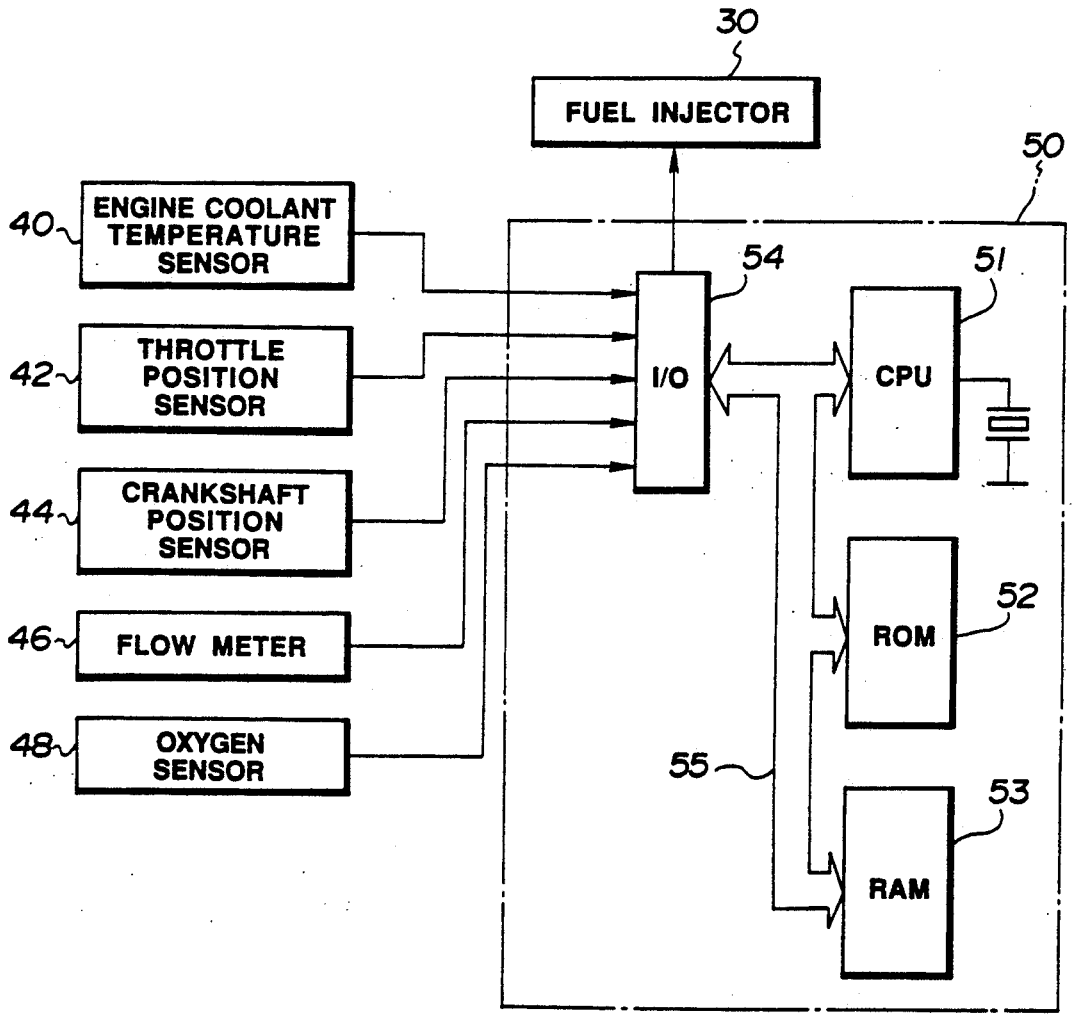
FIG. 2 is a schematic block diagram of the control unit used in the fuel delivery control apparatus of the invention.

Referring to FIG. 2, the control unit 50 comprises a digital computer which includes a central processing unit (CPU) 51, a read only memory (ROM) 52, a random access memory (RAM) 53, and an input/output control unit (I/O) 54. The central processing unit 51 communicates with the rest of the computer via data bus 55. The input/output control unit 54 includes an analog-to-digital converter which receives analog signals from the flow meter and other sensors and converts them into digital form for application to the central processing unit 51 which selects the input channel to be converted. The read only memory 52 contains programs for operating the central processing unit 51 and further contains appropriate data in look-up tables used in calculating appropriate values for fuel delivery requirement. The central processing unit 51 is programmed in a known manner to interpolate between the data at different entry points.

The central processing unit 51 calculates the fuel delivery requirement in the form of fuel-injection pulse-width. For this purpose, a basic value Tp for fuel-injection pulse-width is calculated as $$Tp = k \times Q/N$$

where k is a constant, Q is the intake air flow and N is the engine speed. The calculated fuel-injection pulse-width basic value Tp is then corrected for various engine operating parameters. The corrected fuel-injection pulse-width value Ti is given as $$Ti = Tp \times \text{COEF} \times \text{ALPHA} + Ts$$

where ALPHA is a correction factor related to the oxygen content of the exhaust gases for providing a closed loop air/fuel ratio control, Ts is a correction factor related to the voltage of the car battery, and COEF is a correction factor given as $$\text{COEF} = 1 + KTW + KMR + KAS + KAI + KFUEL$$

where KTW is a correction factor decreasing as the engine coolant temperature increases, and KMR is a correction factor for providing fuel enrichment control under high engine load conditions. The correction factor KMR is greater at a hevier engine load or at a higher engine speed. KAS is a correction factor for providing fuel enrichment control when the engine is cranking, KAI is a correction factor for providing fuel enrichment control when the engine is idling, and KFUEL is a correction factor for providing fuel enrichment control during acceleration.

Control words specifying desired fuel delivery requirements are periodically transferred by the central processing unit 51 to the fuel-injection circuit included in the input/output control circuit 54. The fuel injection control circuit converts the received control word into a fuel injection pulse signal Si for application to a power transistor which connects the fuel injector 30 to the car battery for a time period calculated by the digital computer.

Figure 3:
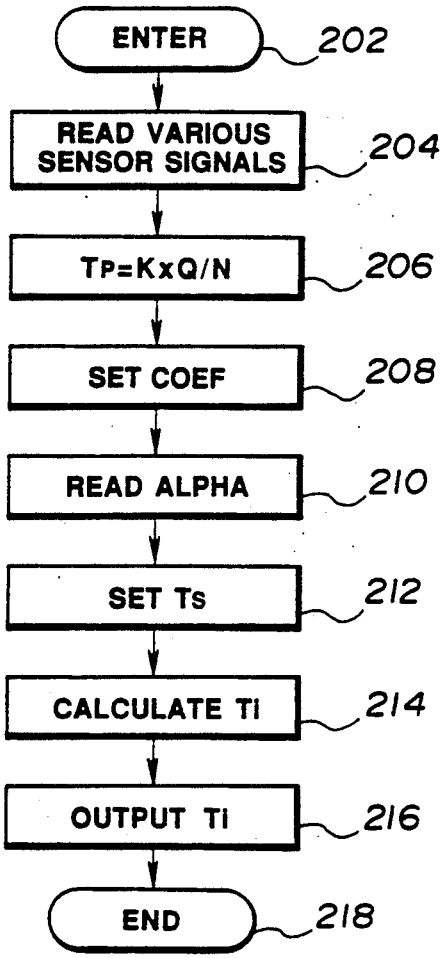
FIG. 3 is a flow diagram illustrating the programming of the digital computer used to calculate a desired value for fuel-injection pulse-width.

FIG. 3 is a flow diagram illustrating the programming of the digital computer as it is used to calculate a desired value for fuel delivery requirement in the form of fuel-injection pulse-width.

The computer program is entered at the point 202 at uniform intervals of time, for example, 10 msec. At the point 204 in the program, the various sensor signals are converted into digital form and read into the computer memory via the data bus 55. At the point 206 in the program, a basic value Tp for fuel-injection pulse-width is calculated by the central processing unit 51 from a relationship programmed into the computer. This relationship defines basic value Tp as $Tp=K\times Q/N$ where K is a constant, Q is the engine load, as inferred from measurement of intake air flow, and N is the engine speed. At the points 208, 210 and 212 in the program, the correction factors COEF, ALPHA and Ts are read into the random access memory 53.

At the point 214 in the program, the central processing unit 51 calculates an actual value Ti for fuel-injection pulse-width as $$Ti=Tp\times \mathrm{COEF}\times \mathrm{ALPHA}+Ts$$

At the point 216 in the program, the calculated actual value Ti for fuel-injection pulse-width is transferred via the data bus 55 to the fuel injection control circuit included in the input/output control unit 54. The fuel injection control circuit then sets the fuel-injection pulse-width according to the calculated value therefor. Following this, the program proceeds to the end point 218.

Figure 4:
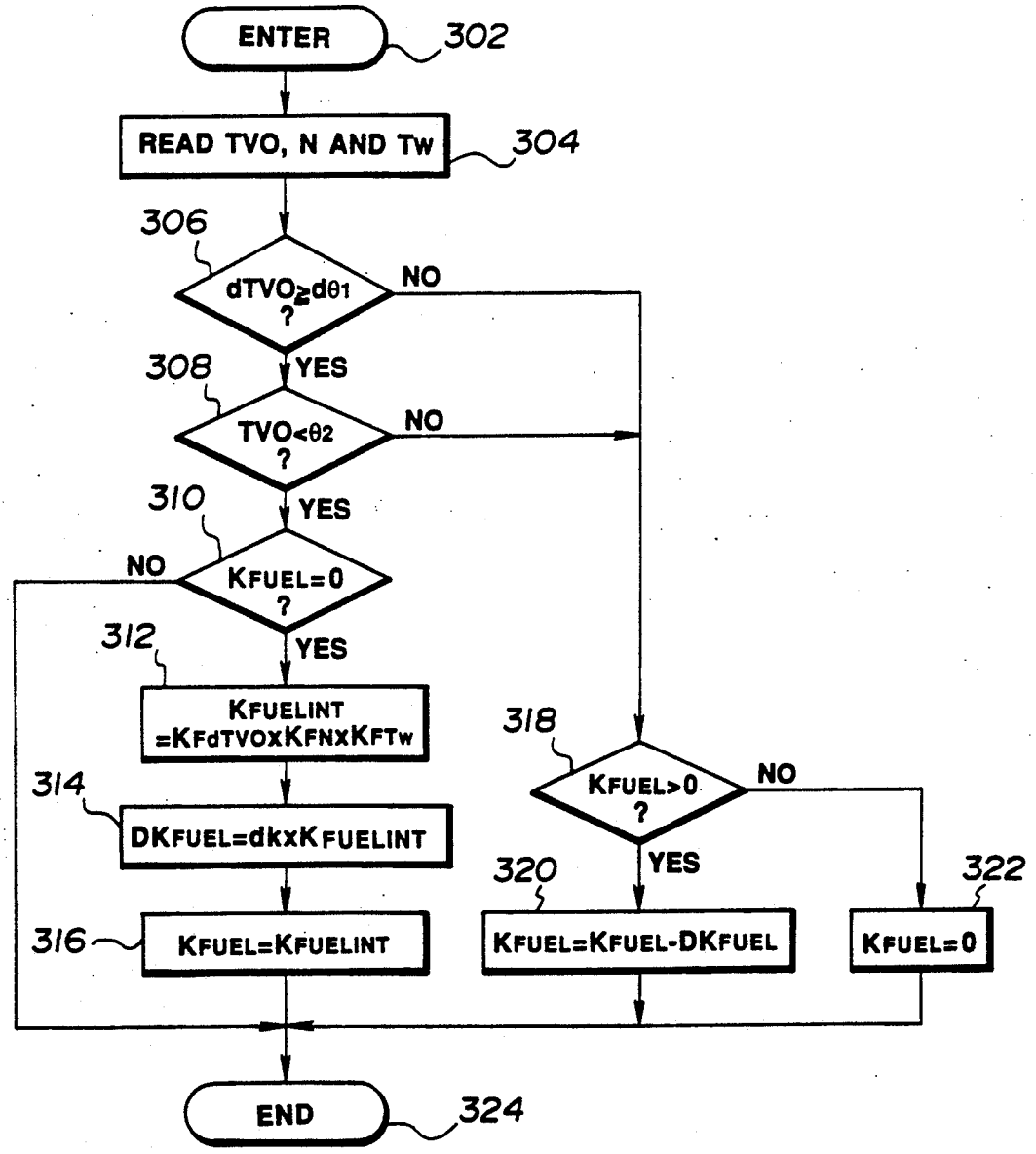
FIG. 4 is a flow diagram illustrating the programming of the digital computer used to calculate the correction factor KFUEL.

FIG. 4 is a flow diagram illustrating the programming of the digital computer as it is used to calculate the correction factor KFUEL for providing fuel enrichment control when the engine is accelerating.

The computer program is entered at the point 302 at uniform intervals of time, for example, 10 msec. At the point 304, the throttle valve position TVO, the engine speed N and the coolant temperature Tw are read into the random access memory 53. At the point 306, a determination is made as to whether or not the rate dTVO of change of the throttle valve position TVO is equal to or greater than a predetermined positive value $d\theta 1$. If the answer to this question is "yes", then it means that the engine is accelerating and the program proceeds to the point 308. Otherwise, the program proceeds to the point 318. It is to be noted that the engine accelerating condition may be detected when the rate of change of the basic value Tp for fuel-injection pulse-width is equal to or greater than a predetermined positive value.

At the point 308 in the program, a determination is made as to whether or not the throttle valve position TVO is less than a predetermined value $\theta 2$. If the answer to this question is "yes", then it means that the engine is operating at a light load and the program proceeds to the point 310. Otherwise, the program proceeds to the point 318. It is to be noted this determination may be made based upon the basic value Tp for fuel-injection pulse-width or the like from which the engine load can be inferred.

At the point 310 in the program, a determination is made as to whether the correction factor KFUEL is zero or positive. If the correction factor KFUEL is equal to zero, then the program proceeds to the point 312. Otherwise, the program proceeds to the end point 324.

At the point 312 in the program, an initial value KFUELINT of the correction factor KFUEL is calculated as $\mathrm{KFUELINT}=\mathrm{KFdTVO}\times\mathrm{KFN}\times\mathrm{KFTw}$ where KFdTVO is a correction factor related to the rate dTVO of change of the throttle valve position TVO, KFN is a correction factor related to the engine speed N, and KFTw is a correction factor related to the coolant temperature Tw. For this purpose, the random access memory 53 has first, second and third mapping functions stored therein. The first mapping function is implemented in a rewrite-enable manner by storing KFN values KFN(1), KFN(2), . . . KFN(A) for engine speed N at respective selected points (address locations) AXN(1), AXN(2), . . . AXN(A), each of which, when addressed, will produce a KFN value based upon an instantaneous value of engine speed N. The second mapping function is implemented in a rewrite-enable manner by storing KFTw values KFTw(1), KFTw(2), . . . KFTw(A) for engine coolant temperature Tw at respective selected points (address locations) AXTw(1), AXTw(2), . . . AXTw(A), each of which, when addressed, will produce a KFTw value based upon an instantaneous value of engine coolant temperature Tw. The third mapping function is implemented in a rewrite-enable manner by storing KFdTVO values KFdTVO(1), KFdTVO(2), . . . KFdTVO(A) for throttle valve position changing rate dTVO at respective selected points (address locations) AXdTVO(1), AXdTVO(2), . . . AXdTVO(A), each of which, when addressed, will produce a KFdTVO value based upon an instantaneous value of throttle valve position changing rate dTVO. The central processing unit 51 is programmed in a known manner to interpolate between the data at different selected points.

The program then proceeds to the point 314 where the central processing unit 51 calculates a rate DKFUEL of decrease of the correction factor KFUEL by multiplying the initial value KFUELINT by a predetermined positive value DKFUEL less than 1 (unity). At the point 316 in the program, the calculated initial value KFUELINT is set for the correction factor KFUEL. Following this, the program proceeds to the end point 324.

Figure 5:
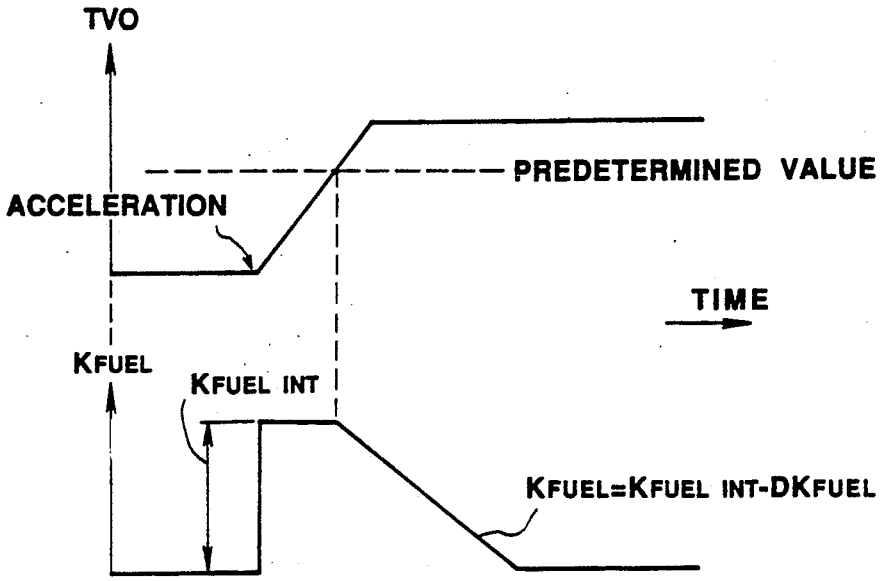
FIG. 5 is a graph used in explaining changes in the correction factor KFUEL with time in connection with throttle valve position changes.

At the point 318 in the program, a determination is made as to whether or not the correction factor KFUEL is positive. If the answer to this question is "yes", then the program proceeds to the point 320 where the central processing unit 51 sets the correction factor KFUEL at a new value calculated by subtracting the decrease rate DKFUEL calculated at the point 314 from the last value of the correction factor KFUEL (initially set at KFUELINT as described in connection with the point 316). If the correction factor KFUEL is equal to zero or negative, then the program proceeds from the point 318 to the point 322 where the correction factor KFUEL is set at zero. Following this, the program proceeds to the end point 324. FIG. 5 shows a fashion in which the correction factor KFUEL changes with the lapse of time in connection with throttle valve position changes.

Figure 6:
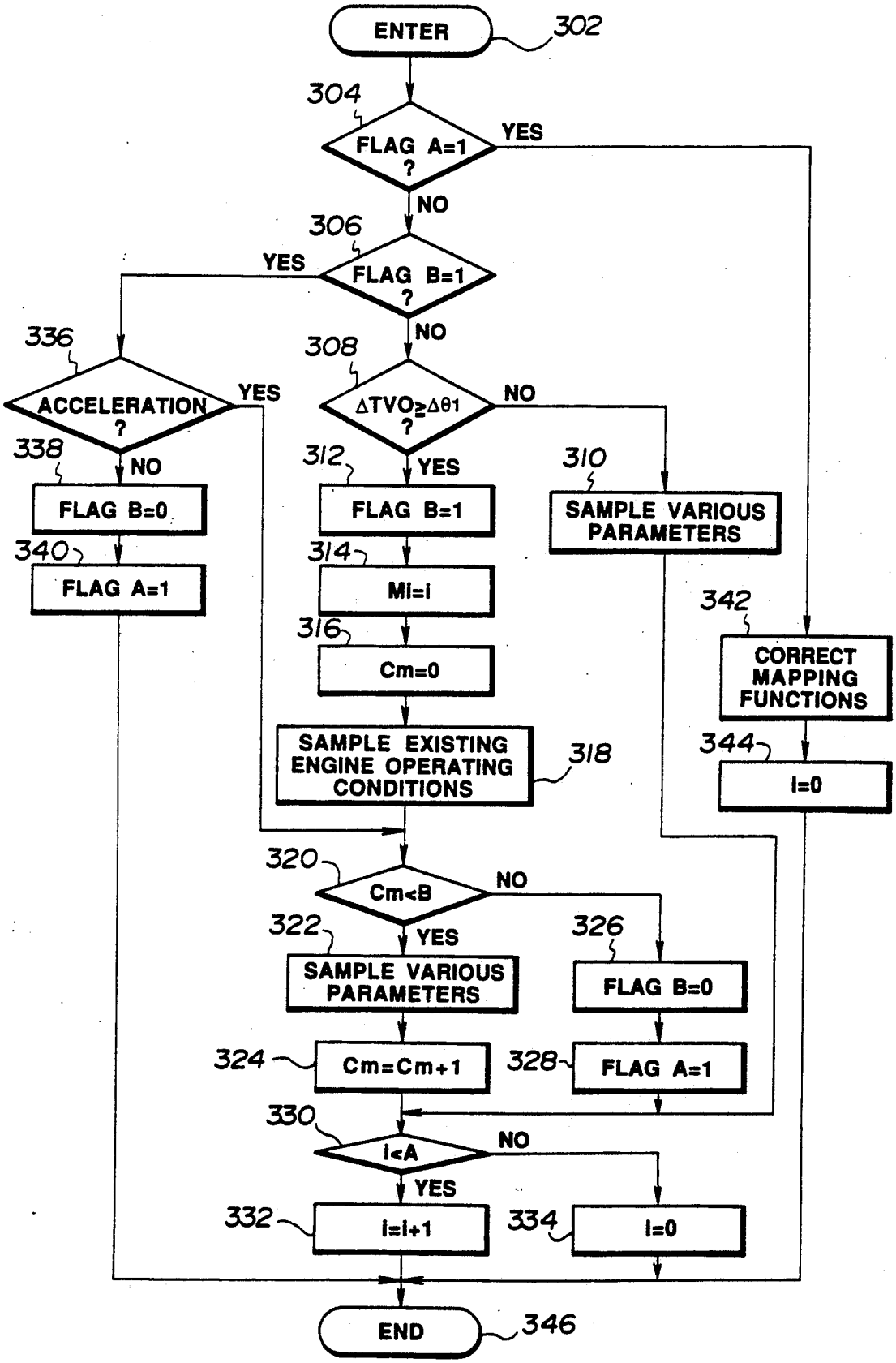
FIG. 6 is a flow diagram illustrating the programming of the digital computer used to provide a correction factor learning function of relating the correction factor KFUEL to recent engine operating conditions.

FIG. 6 is an overall flow diagram illustrating the programming of the digital computer as it is used to provide a KFUEL learning function of relating the correction factor KFUEL to existing engine operating conditions.

The computer program is entered at the point 302 in synchronism with the crankshaft position pulse signal. At the point 304, a determination is made as to whether or not a flag A has been set. The flag A is set to indicate that the program sequence is in the course of an operation of correcting the mapping functions. If the answer to the question is "yes", then the program proceeds to the point 342. Otherwise, the program proceeds to another determination step at the point 306. This determination is as to whether or not a flag B is set. The flag B is set to indicate that the program sequence is in the course of an operation of reading various parameters Tp, Te, Teb and INF used in rewriting the correction factors KFN, KFTw and KFdTVO. If the answer to this question is "yes", then the program proceeds to the point 336. Otherwise, the program proceeds to the point 308. It is to be noted that the program will proceeds from the entry point 302 to the point 308 in the first cycle of execution of this computer program.

At the point 308 in the program, a determination is made as to whether or not the rate dTVO of change of the throttle valve position TVO is equal to or greater than a predetermined value $d\theta 1$. If the answer to this question is "yes", then it means that the engine is accelerating and the program proceeds to the point 312. Otherwise, it means that the engine is not accelerating and the program proceeds to the point 310 where the parameters Tp, Te, Teb and INF are calculated and stored into respective memory sections assigned therefor in the random access memory 53. Each of the parameters is stored at a memory location specified by an ordinal number i. The ordinal number i is incremented by one, from 1 to a predetermined maximum value A, in each cycle of execution of the program. Thus, the number of values accumulated in the random access memory 53 for each of the parameter is equal to the maximum value A. This step will be described in greater detail in connection with the flow diagram of FIG. 7. Upon completion of this step, the program proceeds to the point 330.

At the point 312 in the program, the flag B is set. The program then proceeds to the point 314 where the existing ordinal number i is stored or marked as Mi. Thus, Mi is an ordinal number existing at the start of acceleration of the engine. At the point 316 in the program, the count Cm of a first counter is cleared to zero. The count Cm indicates the number of the values accumulated in the random access memory 5 to form each of the time series data during engine acceleration. The program then proceeds to the point 318 where the existing value of the rate dTVO of change of the throttle valve position TVO, the existing value of the coolant temperature Tw and the existing value of the engine speed N are measured and stored in the respective memory sections of the random access memory 53 at the memory location Mi. Thus, the random access memory 53 stores the engine operating conditions dTVO, Tw and N existing at the start of acceleration of the engine. This step will be described in greater detail in connection with the flow diagram of FIG. 8. Upon completion of these measurements, the program proceeds to the point 320.

At the point 320 in the program, a determination is made as to whether or not the count Cm of the first counter is less than a maximum value B predetermined for the count Cm of the first counter. The maximum value B is less than the predetermined maximum value A which corresponds to the number of memory locations in total assigned for each of the memory sections. If the answer to this question is "yes", then the program proceeds to the point 322 where the parameters Tp, Te, Teb and INF are measured and stored into the respective memory sections of the random access memory 53. This step will be described in greater detail in connection with the flow diagram of FIG. 7. Upon completion of these measurements, the program proceeds to the point 324 where the count Cm of the first counter is advanced by one step. The program then proceeds to the point 330. If the count Cm of the second counter is equal to the predetermined value B, then the program proceeds from the point 320 to the point 326 where the flag B is cleared and then to the point 328 where the flag A is set. Following this, the program proceeds to the point 330.

At the point 330 in the program, a determination is made as to whether or not the ordinal number (i) is less than the predetermined maximum value A. If the answer to this question is "yes", then the program proceeds to the point 332 where the ordinal number (i) is incremented by one and then to the end point 346. Otherwise, the program proceeds to the point 334 where the ordinal number (i) is set at zero and then to the end point 346.

At the point 336 in the program, a determination is made as to whether or not the engine is accelerating. If the answer to this question is "yes", then it means that the engine acceleration continues and the program proceeds to the point 320. Otherwise, the program proceeds to the point 338 where the flag B is cleared and then to the point 340 where the flag A is set. Following this, the program proceeds to the end point 346.

At the point 342 in the program, the mapping functions are corrected. This step will be described in greater detail in connection with the flow diagram of FIGS. 9A and 9B. Upon completion of the mapping function correcting step, the program proceeds to the point 344 where the ordinal number (i) is set at zero. Following this, the program proceeds to the end point 346.

Figure 7:
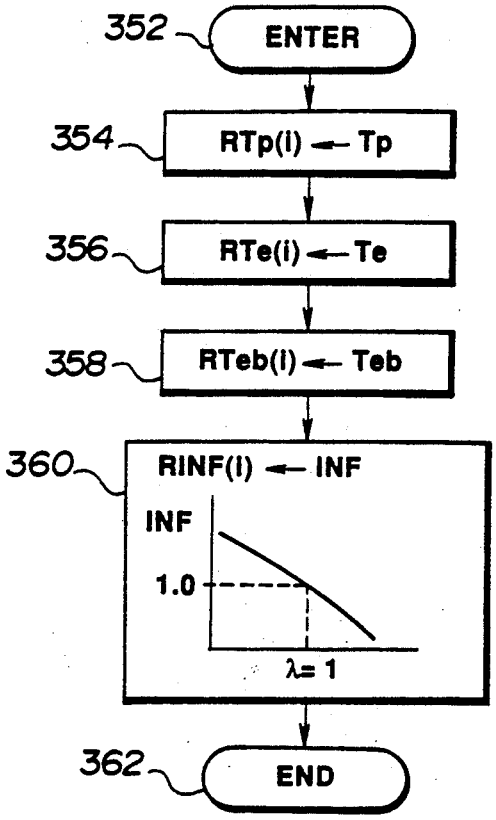
FIG. 7 is a detailed flow diagram illustrating the programming of the digital computer as it is used to sample various parameters.

FIG. 7 is a flow diagram illustrating the programming of the digital computer as it is used to sample the parameters Tp, Te, Teb and INF.

The computer program is entered at the point 352 which corresponds to the point 308 or 320 of the flow diagram of FIG. 6. At the point 354 in the program, a basic value Tp for fuel-injection pulse-width is calculated based upon the existing engine operating conditions and stored at the memory location specified by the exsisting ordinal number (i). In FIG. 7, the character RTp(i) represents the basic value Tp stored at the memory location specified by the ordinal number (i). The basic value Tp is calculated as $$Tp = K \times Q/N$$

where K is a constant, Q is the engine load inferred from intake air flow, and N is the engine speed.

At the point 356 in the program, a first target value Te for fuel-injection pulse-width value for the engine being accelerating is calculated based upon the existing engine operating conditions and stored at the memory location specified by the existing ordinal number (i). In FIG. 7, the character RTe(i) designates the first target value Te stored at the memory location specified by the ordinal number (i). The first target value Te is calculated as $$Te = Tp \times (1 + KFUEL + KTw + KMR + KAS + KAI)$$

where KFUEL is a correction factor for providing fuel enrichment control during engine acceleration, KTw is a correction factor decreasing as the engine coolant temperature increases, KMR is a correction factor for providing fuel enrichment control at high engine loads and high engine speeds, KAS is a correction factor for providing fuel enrichment control when the engine is cranking, and KAI is a correction factor for providing fuel enrichment control when the engine is idling.

At the point 358 in the program, a second target value teb for fuel-injection pulse-width for the engine being not accelerating is calculated based upon the existing engine operating conditions and stored at the memory location specified by the ordinal number (i). In FIG. 7, the character RTeb(i) represents the second target value Teb stored at the memory location specified by the ordinal number (i). The second target value Teb is calculated as $$\begin{aligned} Teb &= Tp \times (1 + KTw + KMR + KAS + KAI) \\ &= Te - KFUEL \times Tp \end{aligned}$$

At the point 360 in the program, a value of the parameter INF, which is related to the actual air/fuel ratio detected by the sensor signal fed from the air/fuel ratio sensor 48, is calculated and stored at the memory location specified by the existing ordinal number (i). In FIG. 7, the character RINF(i) represents the value INF stored at the memory location specified by the ordinal number (i). The parameter INF is calculated from a relationship programmed into the computer. This relationship is shown in the block of the point 360 and it defines this parameter INF as a function of the output of the air/fuel ratio sensor 48.

Following this, the program proceeds to the end point 362 which corresponds to the point 324 or 344 of the flow diagram of FIG. 6.

The above program sequence of steps is repeated at uniform angular intervals of rotation of the engine output shaft to store the calculated basic values Tp, the first target values Te and the second target values Teb in sequence of time to form first, second and third time series data in the respective memory sections of the random access memory 53. The first time series data include RTp(1), RTp(2), . . . RTp(A) stored at the memory locations specified by the ordinal numbers (1), (2), . . . (A), respectively. The second time series data include RTe(1), RTe(2), . . . RTe(A) stored at the memory locations specified by the ordinal numbers (1), (2) . . . (A), respectively. The third time series data includes RTeb(1), RTeb(2), . . . RTeb(A) stored at the memory locations specified by the ordinal number (1), (2), . . . (A).

Figure 8:
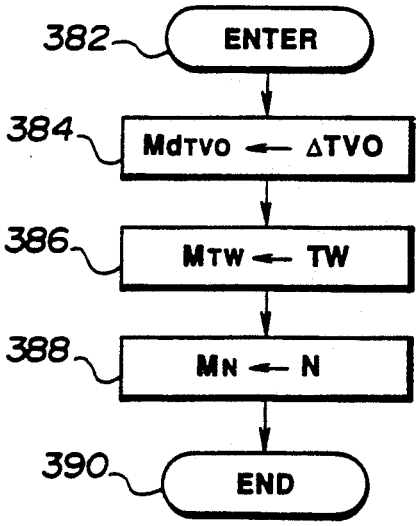
FIG. 8 is a detailed flow diagram illustrating the programming of the digital computer as it is used to sample various engine operating conditions at the start of acceleration of the engine.

FIG. 8 is a flow diagram illustrating the programming of the digital computer as it is used to measure engine operating conditions at the start of acceleration of the engine.

The computer program is entered at the point 382 which corresponds to the point 316 of the flow diagram of FIG. 6. At the point 384 in the program, the existing value of the rate dTVO of change of the throttle valve position TVO is measured and stored in the memory section assigned therefor at the memory location specified by the ordinal number (Mi) set at the point 314 of the flow diagram of FIG. 6. In FIG. 8, the character MdTVO represents the throttle valve position changing rate value dTVO stored at the memory location specified by the ordinal number (Mi).

At the point 386 in the program, the existing value of the engine coolant temperature Tw is measured and stored in the memory section assigned therefor at the memory location specified by the ordinal number (Mi). In FIG. 8, the character MTw represents the engine coolant temperature value Tw stored at the memory location specified by the ordinal number (Mi).

At the point 388 in the program, the existing value of the engine speed N is measured and stored in the memory section assigned therefor at the memory location specified by the ordinal number (Mi). In FIG. 8, the character MN represents the engine speed value N stored at the memory location specified by the ordinal number (Mi). Following this, the program proceeds to the end point 390 which corresponds to the point 320 of the flow diagram of FIG. 6.

Figure 9A:
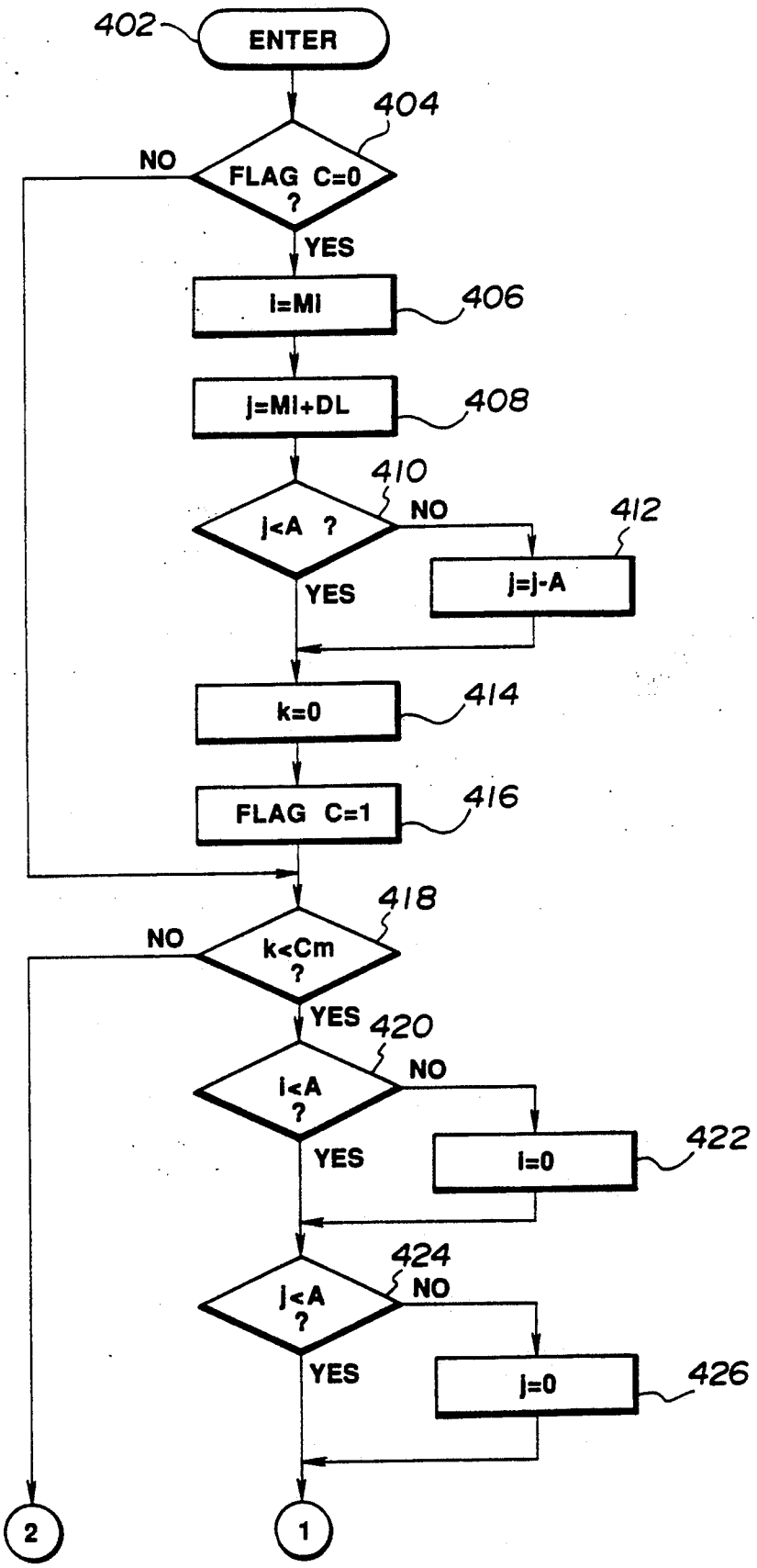
FIGS. 9A and 9B are a detailed flow diagram illustrating the programming of the digital computer as it is used to correct the mapping functions.
Figure 9B:
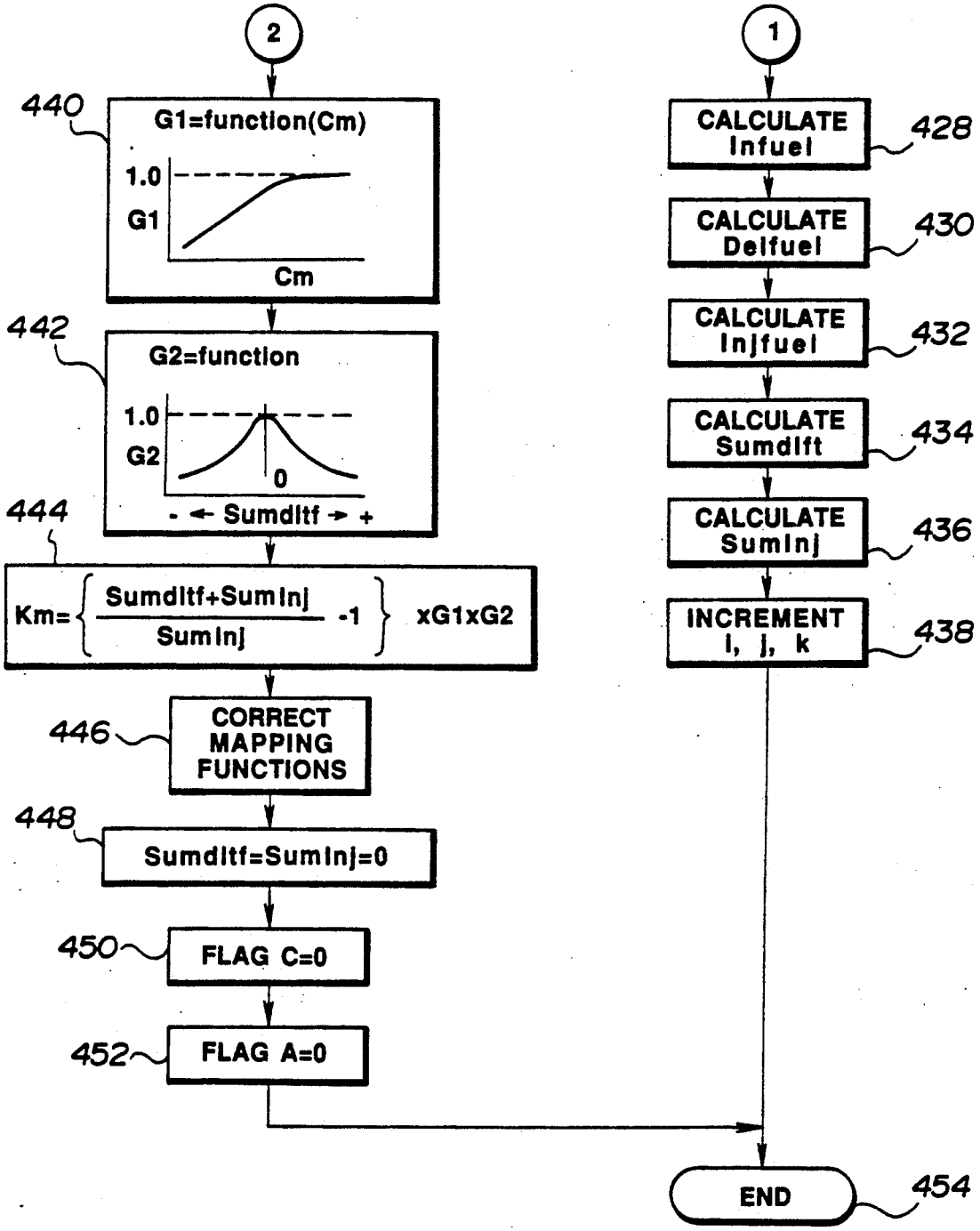

FIGS. 9*a* and 9*b* are a flow diagram illustrating the programming of the digital computer as it is used to correct the mapping functions.

The computer program is entered at the point 402 which corresponds to the point 304 of the flow diagram of FIG. 6. At the point 404 in the program, a determination is made as to whether or not a flag C has been cleared. If the answer to this question is "yes", then the program proceeds to the point 406. Otherwise, the program proceeds to the point 418.

At the point 406 in the program, the ordinal number (i) is set at Mi which has been stored or marked at the point 314 of the flow diagram of FIG. 6 to indicate the ordinal number (i) existing at the start of acceleration of the engine. The program then proceeds to the point 408 where an ordinal number (j) is set at (Mi+DL) where DL corresponds to a time delay required for air/fuel ratio detection. This time delay includes the time delay between the time the air-fuel mixture enters the combustion chamber 12 and the time the exhaust gases resulting from combustion of the air-fuel mixture reach the air/fuel ratio sensor 48 and the time delay caused by the response time of the air/fuel ratio sensor 48. This setting is effective to compensate for the time delay required for air/fuel ratio detection.

At the point 410 in the program, a determination is made as to whether or not the ordinal number (j) is less than the maximum value A. If the answer to this question is "yes", then the program to the point 414. Otherwise, the program proceeds to the point 412 where the ordinal number (j) is set at j—A and then to the point 414. At the point 414 in the program, the count k of a second counter is set at zero. The count k indicates the number of values stored in the random access memory 53 to form each of the time series data used in correcting the mapping functions. The program then proceeds to the point 416 where the flag C is set and then to the point 418.

At the point 418 in the program, a determination is made as to whether or not the count k of the second counter is less than the count Cm of the first counter. If the answer to this question is "yes", then it means that the number of values stored to form each of the time series data used in correcting the mapping functions is insufficient and the program proceeds to the point 420. Otherwise, the number of values stored to form each of the time series data used in correcting the mapping functions is sufficient and the program proceeds to the point 440.

At the point 420 in the program, a determination is made as to whether or not the existing ordinal number (i) is less than the maximum value A. If the answer to this question is "yes", then the program proceeds to the point 424. If the existing ordinal number (i) is equal to the maximum value A, then the program proceeds from the point 420 to the point 422 where the ordinal number (i) is set at zero and then to the point 424.

At the point 424 in the program, a determination is made as to whether or not the existing ordinal number (j) is less than the maximum value A. If the answer to this question is "yes", then the program proceeds to the point 428. If the existing ordinal number (j) is equal to the maximum value A, then the program proceeds from the point 424 to the point 426 where the ordinal number (j) is set at zero and then to the point 428.

Figure 10:
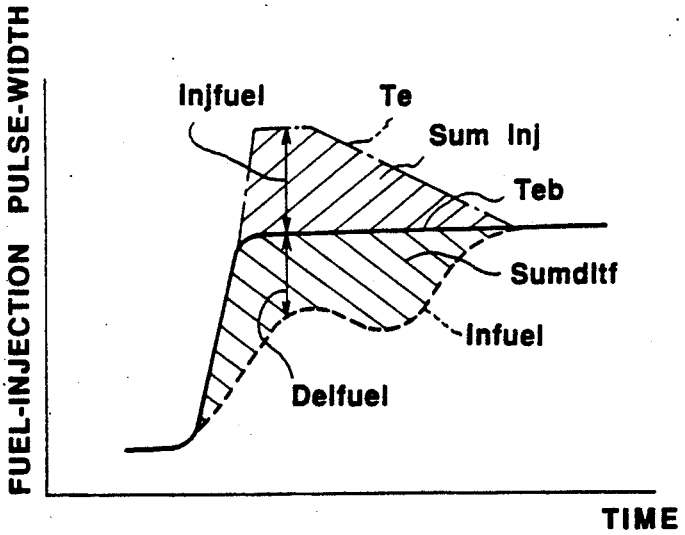
FIG. 10 is a graph of fuel-injection pulse-width versus time.

At the point 428 in the program, the central processing unit 51 estimates a value Infuel (see FIG. 10) of the amount of fuel which have entered the combustion chamber 12. The estimated value Infuel is calculated as $$\text{Infuel} = RTp(i) \times RINF(j)$$

where RTp(i) is the basic value Tp stored at the memory location specified by the ordinal number (i) and RINF(j) is the actual air/fuel ratio related parameter INF stored at the memory location specified by the ordinal number (j).

At the point 430 in the program, the central processing unit 51 calculates a difference Delfuel (see FIG. 10) of the estimated value Infuel from the stored target value RTeb(i) as $$\text{Delfuel} = RTeb(i) - \text{Infuel}$$

where RTeb(i) is the target value Teb stored at the memory location specified by the ordinal number (i).

At the point 432 in the program, the central processing unit 51 calculates a difference Injfuel of the stored target value RTeb(i) from the stored target value RTe(i) as $$\text{Injfuel} = RTe(i) - RTeb(i)$$

where RTe(i) is the target value Te stored at the memory location specified by the ordinal number (i) and RTeb(i) is the target value Teb stored at the memory location specified by the ordinal number (i).

At the point 434 in the program, the central processing unit 51 calculates the integrated value Sumdltf (see FIG. 10) of the difference Delfuel as $$\text{Sudltf} = \sum_{k=0}^{Cm} \text{Delfuel}(k) = \text{Sumdltfold} + \text{Delfuel}$$

where Sumdltfold is the last value of the integrated value Sudltf.

At the point 436 in the program, the central processing unit 51 calculates the integrated value SumInj (see FIG. 10) of the difference Injfuel as $$\text{SumInj} = \sum_{k=0}^{Cm} \text{Injfuel}(k) = \text{SumInjold} + \text{Injfuel}$$

where SumInjold is the last value of the integrated value SumInj.

At the point 438 in the program, i, j and k (k<B) are incremented. Following this, the program proceeds to the end point 454 which corresponds to the point 344 of the flow diagram of FIG. 6.

At the point 440 in the program, the central processing unit 51 calculates a first factor G1 from a relationship programmed into the computer. This relationship is shown in the block of the point 440 and it defines the first factor G1 as a function of the number Cm of the time series data accumulated in the random access memory 53 after the start of acceleration of the engine. The first factor G1 increases gradually toward 1.0 as the number Cm increases. The first factor G1 indicates the degree of reliability of the accumulated time series data.

At the step 442 in the program, the central processing unit 51 calculates a second factor G2 from a relationship programmed into the computer. This relationship is shown in the block of the point 442 and it defines the second factor G2 as a function of the integrated value Sumdltf. The second factor G2 increases gradually toward 1.0 as the integrated value Sumdltf increases when the integrated value Sumdltf is less than zero and decreases gradually as the integrated value Sumdltf increases when the integrated value Sumdltf exceeds zero. This is effective to prevent the leaning correction rate value Km from increasing at an excessive rate when the integrated value Sumdlft is great.

At the point 444 in the program, the central processing unit 51 calculates the learning correction rate Km as $$Km = \left\{ \frac{\text{Sumdltf} + \text{SumInj}}{\text{SumInj}} - 1 \right\} \times G1 \times G2$$

At the point 446, the correction factors KFN, KFTw and KFdTVO are rewritten. This step will be described in greater detail in connection with FIG. 11.

At the point 448 in the program, the integrated values Sumdltf and SumInj are cleared to zero. The program then proceeds to the point 450 where the flag C is cleared and then to the point 452 where the flag A is cleared. Following this, the program proceeds to the end point 454.

Figure 11:
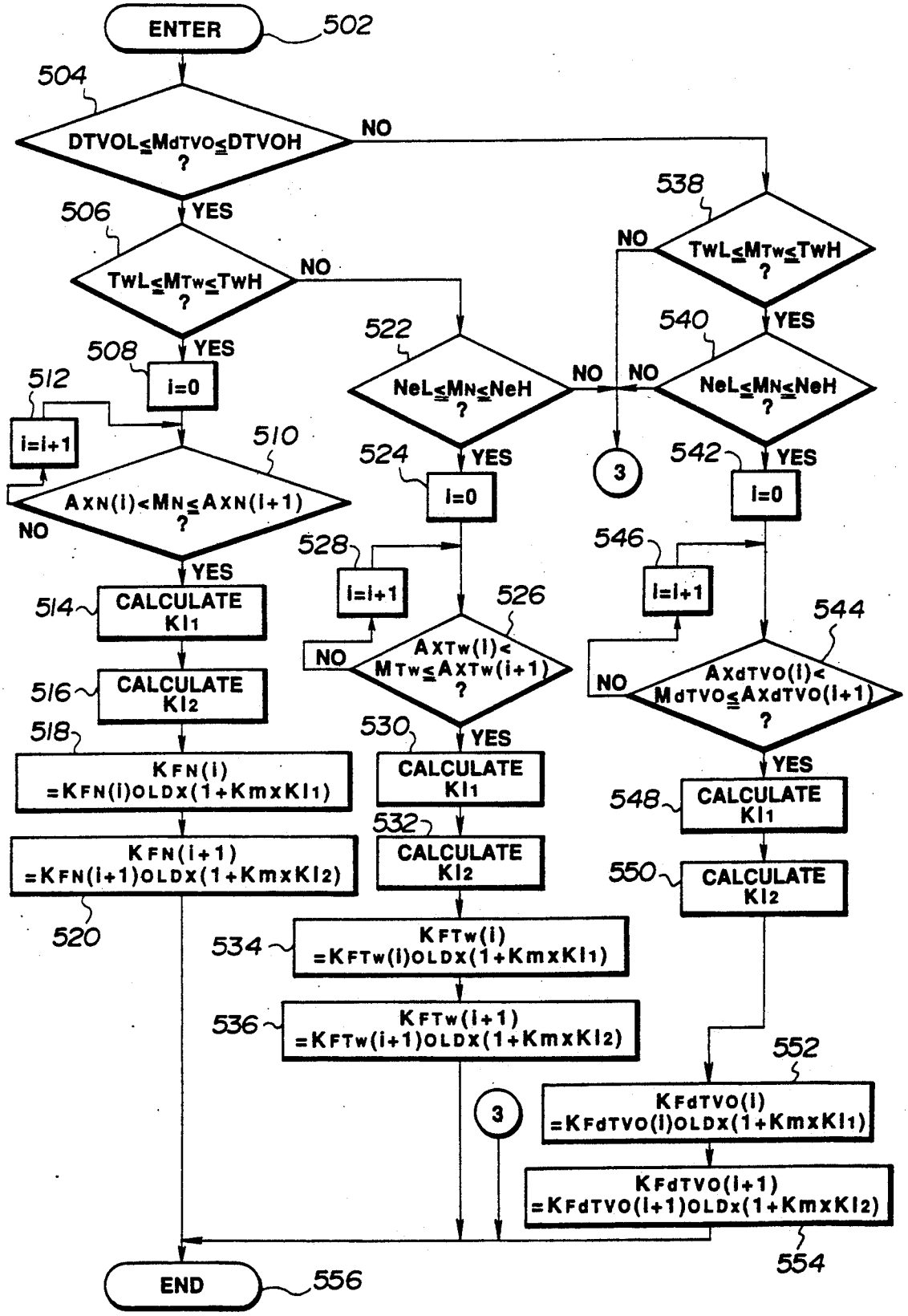
FIG. 11 is a detailed flow diagram illustrating the programming of the digital computer as it is used to rewrite the correction factor values in each of the mapping functions.

FIG. 11 is a flow diagram illustrating the programming of the digital computer as it is used to rewrite the correction factors KFN, KFTw and KFdTVO stored in the first, second and third mapping functions of the random access memory 53.

The computer program is entered at the point 502 which corresponds to the point 444 of the flow diagram of FIG. 9B. At the point 504 in the program, a determination is made as to whether or not the stored value MdTVO of the rate dTVO of change of the throttle valve position TVO is within a range defined by lower and upper limits DTVOL AND DTVOH. If the answer to this question is "yes", then the program proceeds to the point 506. Otherwise, the program proceeds to the point 538.

At the point 506 in the program, a determination is made as to whether or not the stored engine coolant temperature value MTw is within a range defined by lower and upper limits TwL and TwH. If the answer to this question is "yes", then it means that the correction factor KFN related to the engine speed N is required to be rewritten and the program proceeds to the point 508. Otherwise, the program proceeds to the point 522.

At the point 508 in the program, the ordinal number (i) is set at zero. The program then proceeds to the point 510 where a determination is made as to whether or not the stored engine speed value MN exists between adjacent two selected points AXN(i) and AXN(i+1). If the answer to this question is "yes", then the program proceeds to the point 514. Otherwise, the program proceeds to the point 512 where the ordinal number (i) is incremented and then the program is returned to the point 510. During these steps, the central processing unit 51 finds adjacent two selected points AXN(i) and AXN(i+1) between which the stored engine speed value MN exists.

Figure 12:
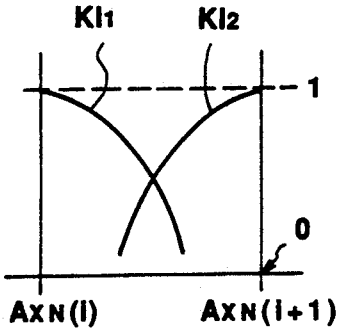
FIG. 12 is a graph used in explaining first and second weights used in modifiying the correction factor values stored at adjacent two selected points.

At the point 514 in the program, the central processing unit 51 calculates a first weight Kl1 from a relationship programmed into the computer. This relationship defines the first weight Kl1 as a function of the difference between the selected point AXN(i) and the stored engine speed value MN, as shown in FIG. 12. At the point 516 in the program, the central processing unit 51 calculates a second weight Kl2 from a relationship programmed into the computer. This relationship defines the second weight Kl1 as a function of the difference between the selected point AXN(i+1) and the stored engine speed value MN, as shown in FIG. 12.

At the point 518 in the program, the central processing unit 51 replaces the last value KFN(i)old of the correction factor KFN with a new value KFN(i) calculated as $$KFN(i)=KFN(i)\text{old}\times(1+Km\times Kl1)$$

At the point 520 in the program, the central processing unit 51 replaces the last value KFN(i+1)old of the correction factor KFN with a new value KFN(i+1) calculated as $$KFN(i+1)=KFN(i+1)\text{old}\times(1+Km\times Kl2)$$

Following this, the program proceeds to the end point 556 which corresponds to the point 448 of the flow diagram of FIG. 9B.

At the point 522 in the program, a determination is made as to whether or not the stored engine speed value MN is within a range defined by lower and upper limits NeL and NeH. If the answer to this question is "yes", then it means that the correction factor KFTw related to the engine coolant temperature Tw is required to be rewritten and the program proceeds to the point 524. Otherwise, the program proceeds to the end point 556.

At the point 524 in the program, the ordinal number (i) is set at zero. The program then proceeds to the point 526 where a determination is made as to whether or not the stored engine coolant temperature value MTw exists between adjacent two selected points AXTw(i) and AXTw(i+1). If the answer to this question is "yes", then the program proceeds to the point 530. Otherwise, the program proceeds to the point 528 where the ordinal number (i) is incremented and then the program is returned to the point 526. During these steps, the central processing unit 51 finds adjacent two selected points AXTw(i) and AXTw(i+1) between which the stored engine coolant temperature value MTw exists.

At the point 530 in the program, the central processing unit 51 calculates a first weight Kl1 from a relationship programmed into the computer. This relationship is similar to the relationship shown in FIG. 12 and it defines the first weight Kl1 as a function of the difference between the selected point AXTw(i) and the stored engine coolant temperature value MTw. At the point 532 in the program, the central processing unit 51 calculates a second weight Kl2 from a relationship programmed into the computer. This relationship is similar to the relationship shown in FIG. 12 and it defines the second weight Kl1 as a function of the difference between the selected point AXTw(i+1) and the stored engine coolant temperature value MTw.

At the point 534 in the program, the central processing unit 51 replaces the last value KFTw(i)old of the correction factor KFTw with a new value KFTw(i) calculated as $$KFTw(i)=KFTw(i)\text{old}\times(1+Km\times Kl1)$$

At the point 536 in the program, the central processing unit 51 replaces the last value KFTw(i+1)old of the correction factor KFTw with a new value KFTw(i+1) calculated as $$KFTw(i+1)=KFTw(i+1)\text{old}\times(1+Km\times Kl2)$$

Following this, the program proceeds to the end point 556 which corresponds to the point 448 of the flow diagram of FIG. 9B.

At the point 538 in the program, a determination is made as to whether or not the stored engine coolant temperature value MTw is within a range defined by lower and upper limits TwL and TwH. If the answer to this question is "yes", then the program proceeds to the point 540. Otherwise, the program proceeds to the end point 556.

At the point 540 in the program, a determination is made as to whether or not the stored engine speed value MN is within a range defined by lower and upper limits MeL and MeH. If the answer to this question is "yes", then it means that the correction factor KFdTVO related to the throttle valve position changing rate dTVO is required to be rewritten and the program proceeds to the point 542. Otherwise, the program proceeds to the end point 556.

At the point 542 in the program, the ordinal number (i) is set at zero. The program then proceeds to the point 544 where a determination is made as to whether or not the stored throttle valve position changing rate value MdTVO exists between adjacent two selected points AXdTVO(i) and AXdTVO(i+1). If the answer to this question is "yes", then the program proceeds to the point 548. Otherwise, the program proceeds to the point 546 where the ordinal number (i) is incremented and then the program is returned to the point 544. During these steps, the central processing unit 51 finds adjacent two selected points AXdTVO(i) and AXdTVO(i+1) between which the stored thorttle valve position changing rate value MdTVO exists.

At the point 548 in the program, the central processing unit 51 calculates a first weight Kl1 from a relationship programmed into the computer. This relationship is similar to the relationship shown in FIG. 12 and it defines the first weight Kl1 as a function of the difference between the selected point AXdTVO(i) and the stored throttle valve position changing rate value MdTVO. At the point 550 in the program, the central processing unit 51 calculates a second weight K12 from a relationship programmed into the computer. This relationship is similar to the relationship shown in FIG. 12 and it defines the second weight Kl1 as a function of the difference between the selected point AXdTVO(i+1) and the stored throttle valve position changing rate value MdTVO.

At the point 552 in the program, the central processing unit 51 replaces the last value KFdTVO(i)old of the correction factor KFdTVO with a new value KFdTVO(i) calculated as $$KFdTVO(i)=KFdTVO(i)\text{old}\times(1+Km\times Kl1)$$

At the point 554 in the program, the central processing unit 51 replaces the last value KFdTVO(i+1)old of the correction factor KFdTVO with a new value KFdTVO(i+1) calculated as $$KFdTVO(i+1)=KFdTVO(i+1)\text{old}\times(1+Km\times Kl2)$$

Following this, the program proceeds to the end point 556 which corresponds to the point 448 of the flow diagram of FIG. 9B.

What is claimed is:

1. A fuel delivery control apparatus for use with an internal combustion engine having combustion chambers and an output shaft which rotates while it is in operation, comprising:

sensors for deriving sensor signals indicative of existing values of engine operating conditions;

an air/fuel ratio sensor sensitive to exhaust gases discharged from the combustion chambers for producing a signal indicative of an air/fuel ratio at which the engine is operating; and a control unit coupled to the sensors for controlling the amount of fuel metered to the engine based upon the sensed engine operating conditions, the control unit including means for calculating an acceleration enrichment related correction factor KFUEL from a relationship programmed into the control unit to correct the amount of fuel metered to the engine so as to provide acceleration enrichment for a predetermined period of time after the engine acceleration starts, the relationship defining the acceleration enrichment related correction factor as a function of selected engine operating conditions, and means for correcting the relationship based upon recent engine operating conditions, wherein the relationship correcting means includes:

means for estimating a first value of the amount of fuel introduced into an engine combustion chamber for the predetermined period of time;

means for calculating a second value of the uncorrected amount of fuel supplied to the engine for the predetermined period of time;

means for calculating a third value of the amount of fuel supplied to provide acceleration enrichment for the predetermined period of time; and means for correcting the relationship based upon the first, second and third values.

2. The fuel delivery control apparatus as claimed in claim 1, wherein the relationship correcting means includes means for correcting the relationship to equalize the sum of the third value and a difference of the first value from the second value to the third value.

3. A fuel delivery control apparatus for use with an internal combustion engine having combustion chambers and an output shaft which rotates while it is in operation, comprising:

sensors for deriving sensor signals indicative of existing values of engine operating conditions;

an air/fuel ratio sensor sensitive to exhaust gases discharged from the combustion chambers for producing a signal indicative of an air/fuel ratio at which the engine is operating; and a control unit coupled to the sensors for controlling the amount of fuel metered to the engine based upon the sensed engine operating conditions, the control unit including means for calculating an acceleration enrichment related correction factor KFUEL from a relationship programmed into the control unit to correct the amount of fuel metered to the engine so as to provide acceleration enrichment for a predetermined period of time after the engine acceleration starts, the relationship defining the acceleration enrichment related correction factor as a function of selected engine operating conditions, and means for correcting the relationship based upon recent engine operating conditions, wherein the relationship correcting means includes:

first time series data forming means for calculating a basic value Tp for fuel delivery requirement based upon the sensed engine operating conditions repetitively at uniform angular intervals or rotation of the engine output shaft and storing the calculated basic values Tp in sequence of time to form first time series data;

second time series data forming means for calculating a first target value Te for fuel delivery requirement for the engine being accelerating based upon the sensed engine operating conditions repetitively at uniform angular intervals of rotation of the engine output shaft and storing the calculated first target values Te in sequence of time to form second time series data;

third time series data forming means for calculating a second target value Teb for fuel delivery requirement for the engine being not accelerating based upon the sensed engine operating conditions repetitively at uniform angular intervals of rotation of the engine output shaft and storing the calculated second target values Teb in sequence of time to form third time series data;

fourth time series data forming means for calculating an actual air/fuel ratio value INF based upon the sensor signal fed from the air/fuel ratio sensor at uniform angular intervals of rotation of the engine output shaft and storing the calculated actual air/fuel ratio values INF in sequence of time to form fourth time series data; and means for correcting the relationship based upon the first, second, third and fourth time series data.

4. The fuel delivery control apparatus as claimed in claim 3, wherein the relationship correcting means includes:

means for calculating a first integrated value Sumdltf as $$\text{Sumdltf} = \sum_{i=Mi}^{Mi+Cm} \{RTeb(i) - RTp(i) \times RINF(i+x)\}$$

where RTeb(i) is a second target value Teb stored at the i-th memory location to form the third time series data, RTp(i) is a basic value Tp stored at the i-th memory location to form the first time series data, RINF(i+x) is an air/fuel ratio value INF stored at the (i+x)-th memory location to form the fourth time series data, x is a predetermined positive integer corresponding to a time delay required for air/fuel ratio detection, Mi represents the Mi-th memory location at which values are stored to form each of the first, second, third and fourth time series data when engine acceleration starts, and Cm is the number of values stored to form each of the first, second, third and fourth time series data;

means for calculating a second integrated value SumInj as $$\text{SumInj} = \sum_{i=Mi}^{Mi+Cm} \{RTe(i) - RTeb(i)\}$$

where RTe(i) is a first target value Te stored at i-th memory location to form the second time series data, and RTeb(i) is a second target value Teb stored at the i-th memory location to form the third time series data;

means for calculating a ratio Km as $$Km = \frac{\text{Sumdltf.} + \text{SumInj}}{\text{SumInj}} - 1$$

means for correcting the relationship based upon the calculated ratio Km.

5. The fuel delivery control apparatus as claimed in claim 4, wherein the relationship correcting means includes:

means for calculating the acceleration enrichment related correction factor KFUEL as $$KFUEL = KFN \times KFTw \times KFdTVO$$

where KFN is a correction factor related to engine speed, KFTw is a correction factor related to engine coolant temperature, and KFdTVO is a correction factor related to throttle valve position changing rate;

means for calculating the correction factor KFN from a first mapping function which defines the correction factor KFN as a function of engine speed;

means for calculating the correction factor KFTw from a second mapping function which defines the correction factor KFTw as a function of engine coolant temperature;

means for calculating the correction factor KFdTVO from a third mapping function which defines the correction factor KFdTVO as a function of throttle valve changing rate;

means for sampling values of engine speed, engine coolant temperature and throttle valve position changing rate when engine acceleration starts;

means for correcting the first mapping function based upon the calculated ratio Km when the sampled throttle valve position changing rate value is within a range predetermined therefor and when the sampled engine coolant temperature value is within a range predetermined therefor;

means for correcting the second mapping function based upon the calculated ratio Km when the sampled throttle valve position changing rate value is within the range predetermined therefor and when the sampled engine speed value is within a range predetermined therefor; and means for correcting the third mapping function based upon the calculated ratio Km when the sampled engine coolant temperature value is within the ratio predetermined therefor and when the sampled engine speed value is within the range predetermined therefor.

6. The fuel delivery control apparatus as claimed in claim 5, wherein the first mapping function has KFN values of the correction factor KFN implemented in a rewrite-enable manner for engine speed at respective selected points, wherein the second mapping function has KFTw values of the correction factor KFTw implemented in a rewrite-enable manner for engine coolant temperature at respective selected points, and wherein the third mapping function has KFdTVO values of the correction factor KFdTVO implemented in a rewrite-enable manner for throttle valve position changing rate.

7. The fuel delivery control apparatus as claimed in claim 6, wherein the first mapping function correcting means includes means for detecting adjacent two selection points between which the sampled engine speed value exists, and means for correcting the KFN values stored at the detected adjacent two selection points upon the calculated ratio Km, wherein the second mapping function correcting means includes means for detecting adjacent two selection points between which the sampled engine coolant temperature value exists, and means for correcting the KFTw values stored at the detected adjacent two selection points upon the calculated ratio Km, and wherein the third mapping function correcting means includes means for detecting adjacent two selection points between which the sampled throttle valve position changing rate value exists, and means for correcting the KFdTVO values stored at the detected adjacent two selection points upon the calculated ratio Km.

* * * * *